US005867926A

United States Patent [19]

Schmitt

[11] Patent Number: 5,867,926

[45] Date of Patent: Feb. 9, 1999

[54] HOT AIR SNOW AND ICE REMOVER

[76] Inventor: Laura L. Schmitt, 711 Kewaunee St., Racine, Wis. 53402-5036

[21] Appl. No.: 888,259

[22] Filed: Jul. 3, 1997

[51] Int. Cl.[6] ..... E01H 5/10

[52] U.S. Cl. ..... 37/227; 37/230

[58] Field of Search ..... 37/227, 219, 197, 37/228, 229, 226, 231, 230; 126/271.1

[56] References Cited

U.S. PATENT DOCUMENTS

| | | | |
|---|---|---|---|
| 2,820,450 | 1/1958 | Zimmerman | 37/230 |
| 3,142,197 | 7/1964 | Tourneau | 37/235 X |
| 3,174,477 | 3/1965 | Wilson | 37/227 X |
| 3,223,079 | 12/1965 | Keusder et al. | 37/227 X |
| 3,311,104 | 3/1967 | Wollner et al. | 37/227 X |
| 5,125,174 | 6/1992 | Watson et al. | 37/231 |
| 5,140,762 | 8/1992 | Monson | 37/230 X |

*Primary Examiner*—Tamara L. Graysay
*Assistant Examiner*—Thomas A. Beach

[57] ABSTRACT

A portable convection heater for removing ice from a side walk including a cart assembly with an axle and a pair wheels rotatably coupled thereto for allowing the pushing of the cart assembly. Further included is a heat blower housing having a heat blower adapted to blow air downwardly upon the receipt of power and a plurality of heating coils coupled below the blower for heating the air passing therethrough upon the receipt of power. For allowing ideal spacing with respect to the ground, the housing is slidably coupled to the cart assembly thus allowing relative vertical movement thereof. Finally, a plurality of control switches are connected to the blower, heating coils, and a power source for selectively providing power thereto.

8 Claims, 2 Drawing Sheets

FIG. 2
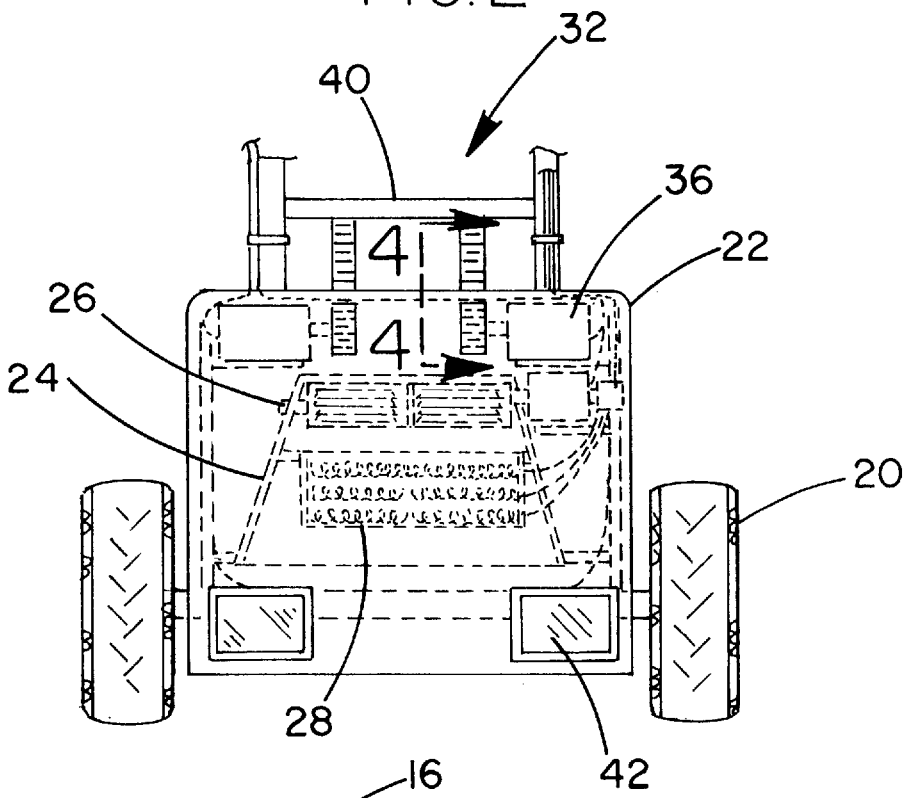
FIG. 3
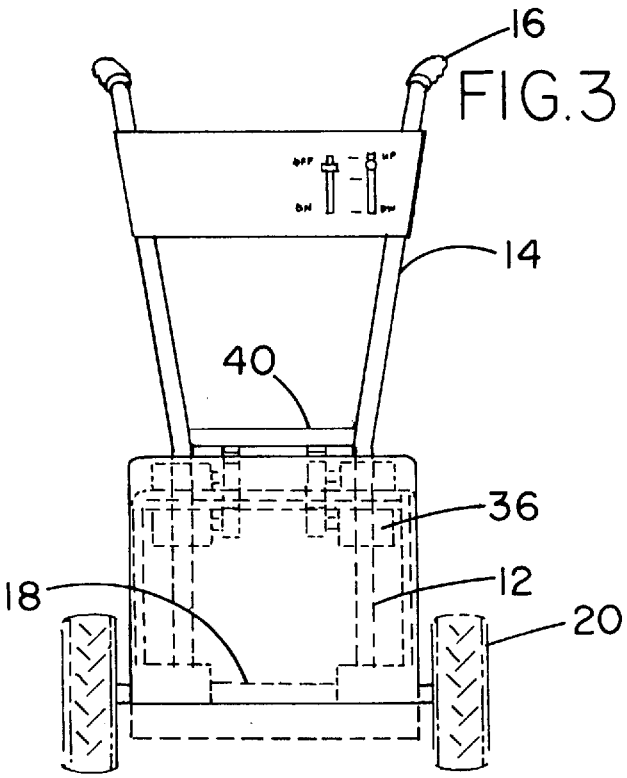
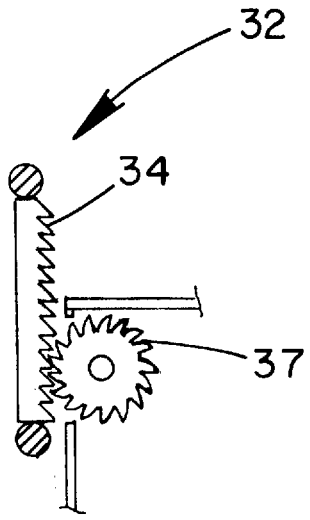
FIG. 4

HOT AIR SNOW AND ICE REMOVER

BACKGROUND OF THE INVENTION

1. Field of the Invention

The present invention relates to snow plows and blowers and more particularly pertains to a new HOT AIR SNOW AND ICE REMOVER for removing snow and ice from side walks with a convection heater.

2. Description of the Prior Art

The use of snow plows and blowers is known in the prior art. More specifically, snow plows and blowers heretofore devised and utilized are known to consist basically of familiar, expected and obvious structural configurations, notwithstanding the myriad of designs encompassed by the crowded prior art which have been developed for the fulfillment of countless objectives and requirements.

Known prior art snow plows and blowers include U.S. Pat. No. 4,033,055; U.S. Pat. No. 3,945,370; U.S. Pat. No. Des. 360,503; U.S. Pat. No. 4,785,561; U.S. Pat. No. 5,365,681; and U.S. Pat. No. 4,071,966.

In these respects, the HOT AIR SNOW AND ICE REMOVER according to the present invention substantially departs from the conventional concepts and designs of the prior art, and in so doing provides an apparatus primarily developed for the purpose of removing snow and ice from side walks with a convection heater.

SUMMARY OF THE INVENTION

In view of the foregoing disadvantages inherent in the known types of snow plows and blowers now present in the prior art, the present invention provides a new HOT AIR SNOW AND ICE REMOVER construction wherein the same can be utilized for removing snow and ice from side walks with a convection heater.

The general purpose of the present invention, which will be described subsequently in greater detail, is to provide a new HOT AIR SNOW AND ICE REMOVER apparatus and method which has many of the advantages of the snow plows and blowers mentioned heretofore and many novel features that result in a new HOT AIR SNOW AND ICE REMOVER which is not anticipated, rendered obvious, suggested, or even implied by any of the prior art snow plows and blowers, either alone or in any combination thereof.

To attain this, the present invention generally comprises a cart assembly with a lower extent having a pair of bottom spaced bars that are vertically oriented. Associated therewith is a pair of intermediate spaced bars each having a bottom end integrally coupled to a top end of the corresponding bottom spaced bar and extending upwardly and rearwardly therefrom. A pair of horizontal handles defining grips are coupled to a top end of an associated one the intermediate spaced bars and extend rearwardly therefrom. As shown in FIG. 1, the intermediate spaced bars extend outwardly from the bottom ends to the top ends thereof. For affording mobility, the cart assembly further has an axle coupled between bottom ends of the bottom spaced bars. The axle has rotatably coupled thereto a pair wheels for allowing movement of the cart assembly. Further provided is a heat blower housing having a top face, a rear face, and a pair of side faces defining an interior space and an open bottom. As best shown in FIG. 2, the housing has an internal cavity situated within the interior space with a top face and beveled side faces. Coupled to the top face of the internal cavity is a blower. Such blower is adapted to blow air downwardly through the open bottom of the housing upon the receipt of power. A plurality of heating coils are coupled between the beveled side faces of the internal cavity below the blower. In use, the heat coils serve to heat the air passing therethrough upon the receipt of power. For reasons that will become apparent later, the housing is slidably coupled to the bottom spaced bars of the cart assembly thus allowing relative vertical movement thereof. As shown in FIGS. 2 & 4, a blower housing elevation control assembly is provided. Such component includes at least one vertically oriented rack coupled between the bottom spaced bars of the cart assembly. Further, at least one motor is situated within the heat blower housing with a gear protruding therefrom. Such gear functions to engage the at least one rack. In operation, the motor is adapted raise the housing upon the receipt of a raise signal and further lower the housing upon the receipt of a lower signal. As shown in FIG. 1, a pair of lights are situated on the front face of the housing adjacent the open bottom and respective side faces thereof. The pair of lights are adapted for illuminating upon the receipt of power. For controlling the supply of power to the various components of the present invention, a plurality of control switches are connected to the blower, heating coils, motor of the elevation control assembly, and lights. The control switches are further connected to a conventional power receptacle via an extension cord. The control switches include a elevation control lever positioned on a plate connected between the intermediate spaced bars adjacent the handles. Such elevation control lever is adapted for transmitting a raise signal in a first orientation and a lower signal in a second orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new HOT AIR SNOW AND ICE REMOVER apparatus and method which has many of the advantages of the snow plows and blowers mentioned heretofore and many novel features that result in a new HOT AIR SNOW AND ICE REMOVER which is not anticipated, rendered obvious, suggested, or even implied by any of the prior art snow plows and blowers, either alone or in any combination thereof.

It is another object of the present invention to provide a new HOT AIR SNOW AND ICE REMOVER which may be easily and efficiently manufactured and marketed.

It is a further object of the present invention to provide a new HOT AIR SNOW AND ICE REMOVER which is of a durable and reliable construction.

An even further object of the present invention is to provide a new HOT AIR SNOW AND ICE REMOVER which is susceptible of a low cost of manufacture with regard to both materials and labor, and which accordingly is then susceptible of low prices of sale to the consuming public, thereby making such HOT AIR SNOW AND ICE REMOVER economically available to the buying public.

Still yet another object of the present invention is to provide a new HOT AIR SNOW AND ICE REMOVER which provides in the apparatuses and methods of the prior art some of the advantages thereof, while simultaneously overcoming some of the disadvantages normally associated therewith.

Still another object of the present invention is to provide a new HOT AIR SNOW AND ICE REMOVER for removing snow and ice from side walks with a convection heater.

Even still another object of the present invention is to provide a new HOT AIR SNOW AND ICE REMOVER that includes a cart assembly with an axle and a pair wheels rotatably coupled thereto for allowing the pushing of the cart assembly. Further included is a heat blower housing having a heat blower adapted to blow air downwardly upon the receipt of power and a plurality of heating coils coupled below the blower for heating the air passing therethrough upon the receipt of power. For allowing ideal spacing with respect to the ground, the housing is slidably coupled to the cart assembly thus allowing relative vertical movement thereof. Finally, a plurality of control switches are connected to the blower, heating coils, and a power source for selectively providing power thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a rear view of the present invention with phantom lines outlining the interior structure of the heat blower housing.

FIG. 3 is a rear view of the present invention.

FIG. 4 is a side view of elevation control assembly of the present invention.

DESCRIPTION OF THE PREFERRED EMBODIMENT

Figure 1:
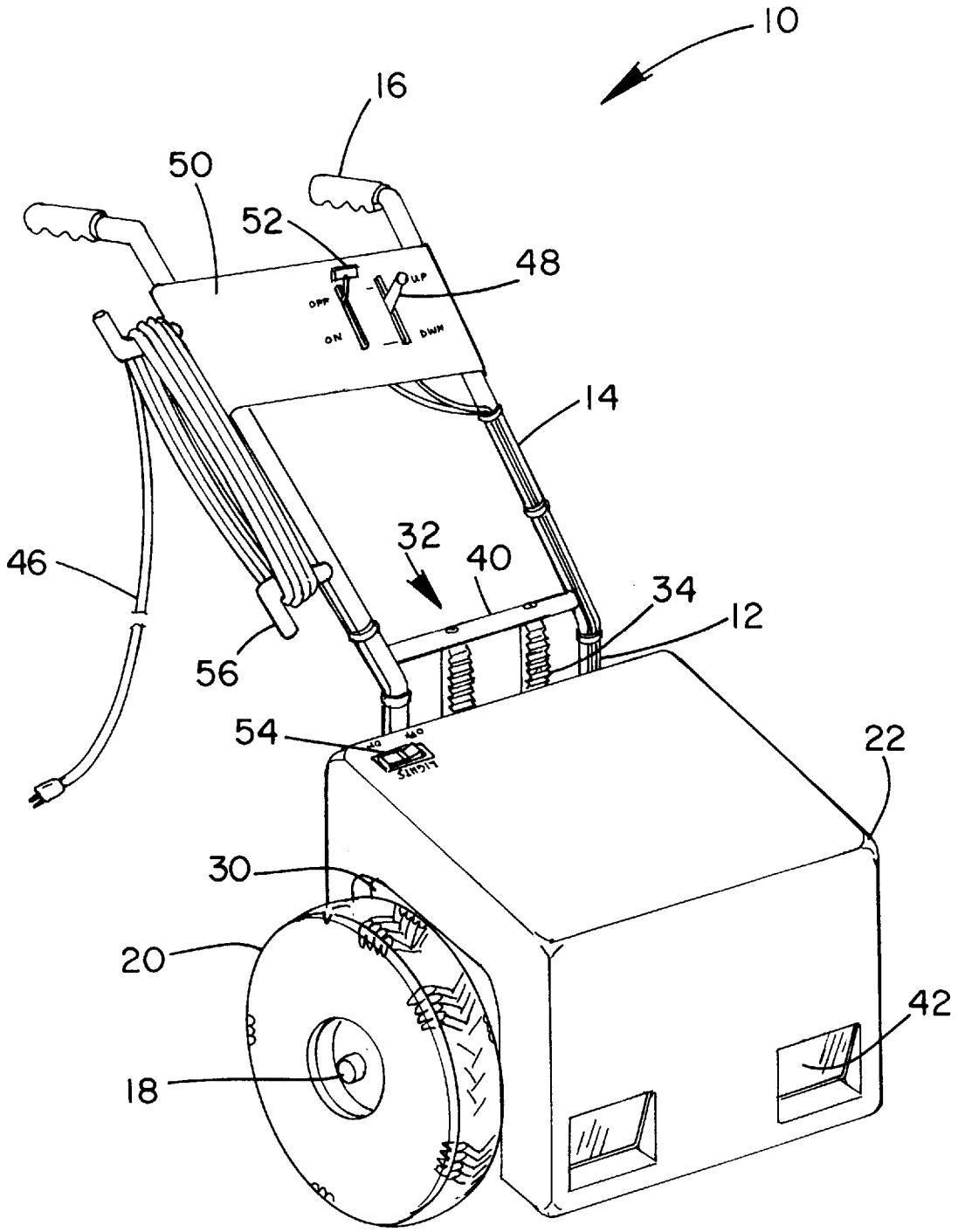
FIG. 1 is a perspective view of a new HOT AIR SNOW AND ICE REMOVER according to the present invention.

With reference now to the drawings, a new HOT AIR SNOW AND ICE REMOVER embodying the principles and concepts of the present invention and generally designated by the reference numeral 10 will be described.

Specifically, the system 10 of the present invention includes a cart assembly with a lower extent having a pair of bottom spaced bars 12 that are vertically oriented. Associated therewith is a pair of intermediate spaced bars 14 each having a bottom end integrally coupled to a top end of the corresponding bottom spaced bar and extending upwardly and rearwardly therefrom. A pair of horizontal handles 16 defining grips are coupled to a top end of an associated one the intermediate spaced bars and extend rearwardly therefrom. As shown in FIG. 1, the intermediate spaced bars extend outwardly from the bottom ends to the top ends thereof. For affording mobility, the cart assembly further has an axle 18 coupled between bottom ends of the bottom spaced bars. The axle has rotatably coupled thereto a pair wheels 20 for allowing movement of the cart assembly.

Further provided is a heat blower housing 22 with a rectilinear configuration having a top face, a rear face, and a pair of side faces defining an interior space and an open bottom. As best shown in FIG. 2, the housing has an internal cavity 24 situated within the interior space with a top face and beveled side faces. Coupled to the top face of the internal cavity is a blower 26. Such blower is adapted to blow air downwardly through the open bottom of the housing upon the receipt of power. A plurality of heating coils 28 are coupled between the beveled side faces of the internal cavity below the blower. In use, the heat coils serve to heat the air passing therethrough upon the receipt of power. For reasons that will become apparent later, the housing is slidably coupled to the bottom spaced bars of the cart assembly thus allowing relative vertical movement thereof. While not shown, such slidable coupling is accomplished by way of a pair of O-rings coupled to the housing and slidably situated about the bottom spaced bars. The side walls of the heat blower housing preferably have oversized wheel wells 30 formed therein.

As shown in FIGS. 2 & 4, a blower housing elevation control assembly 32 is provided. Such component includes at least one vertically oriented rack 34 coupled between the bottom spaced bars of the cart assembly. Further, at least one motor 36 is situated within the heat blower housing with a gear 37, or pinion, protruding therefrom. Such gear functions to engage the at least one rack.

It should be noted that in the preferred embodiment, two racks and motors are provided. The racks are preferably spaced between the bottom spaced bars and extend along the entire height thereof. To accomplish this, a crossbar 40 and the axle are utilized as points of coupling. In operation, the motors are adapted raise the housing upon the receipt of a raise signal and further lower the housing upon the receipt of a lower signal. As such, the user may select the height of the bottom opening of the housing so that optimal heat transfer is afforded and a clearance is provided for anomalies in the sidewalk, ice and the like.

As shown in FIG. 1, a pair of lights 42 are situated on the front face of the housing adjacent the open bottom and respective side faces thereof. The pair of lights is adapted for illuminating upon the receipt of power. As shown in FIG. 1, the lights are ideally angled downwardly toward the ground.

For controlling the supply of power to the various components of the present invention, a plurality of control switches 44 are connected to the blower, heating coils, motor of the elevation control assembly, and lights. The control switches are further connected to a conventional power receptacle via an extension cord 46. The control switches include a elevation control lever 48 positioned on a plate 50 connected between the intermediate spaced bars adjacent the handles. Such elevation control lever is adapted for transmitting a raise signal in a first orientation and a lower signal in a second orientation. It should be noted that the raise and lower signals may simply comprise of voltages having similar magnitudes but different polarities. Also situated on the plate is a heating coil/blower switch 52. A switch 54 associated with the lights is preferably situated on the top face of the housing adjacent the rear face thereof.

Finally, a pair of spaced L-shaped prongs 56 are coupled to one of the intermediate spaced bars of the cart assembly and extend outwardly therefrom. In use, the prongs are adapted for allowing the extension cord to be wrapped thereon when not in use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable convection heater for removing ice from a side walk comprising, in combination:

a cart assembly including a lower extent having a pair of bottom spaced bars with a vertical orientation, a pair of intermediate spaced bars each having a bottom end integrally coupled to a top end of the corresponding bottom spaced bar and extending upwardly and rearwardly therefrom, and a pair of horizontal handles defining grips which are coupled to a top end of an associated one the intermediate spaced bars and extending rearwardly therefrom, wherein the intermediate spaced bars extend outwardly from the bottom ends to the top ends thereof, the cart assembly further having an axle coupled between bottom ends of the bottom spaced bars and a pair wheels rotatably coupled to the axle for allowing movement of the cart assembly;

a heat blower housing having a top face, a rear face, and a pair of side faces defining an interior space and an open bottom, the housing having an internal cavity situated within the interior space with a top face and beveled side faces, a blower coupled to the top face of the internal cavity and adapted to blow air downwardly through the open bottom of the housing upon the receipt of power, and a plurality of heating coils coupled between the beveled side faces of the internal cavity below the blower for heating the air passing therethrough upon the receipt of power, wherein the housing is slidably coupled to the bottom spaced bars of the cart assembly thus allowing relative vertical movement thereof;

a blower housing elevation control assembly including at least one vertically oriented rack coupled between the bottom spaced bars of the cart assembly and at least one motor situated within the heat blower housing with a gear protruding therefrom and engaging the at least one rack, the motor adapted raise the housing upon the receipt of a raise signal and further lower the housing upon the receipt of a lower signal;

a pair of lights situated on the front face of the housing adjacent the open bottom and respective side faces of the housing for illuminating upon the receipt of power;

a plurality of control switches connected to the blower, heating coils, motor of the elevation control assembly, lights, and a conventional power receptacle via an extension cord for selectively providing power thereto, the control switches including a elevation control lever for transmitting a raise signal in a first orientation and a lower signal in a second orientation; and a pair of spaced L-shaped prongs coupled to one of the intermediate spaced bars of the cart assembly and extending outwardly therefrom for allowing the extension cord to be wrapped thereon when not in use.

2. A portable convection heater for removing ice from a side walk comprising:

a cart assembly including an axle and a pair wheels rotatably coupled to the axle for allowing the pushing of the cart assembly;

a heat blower housing including a heat blower adapted to blow air downwardly upon the receipt of power and a plurality of heating coils coupled below the blower for heating the air passing therethrough upon the receipt of power, wherein the housing is slidably coupled to the cart assembly thus allowing relative vertical movement thereof; and a plurality of control switches connected to the blower, heating coils, and a power source for selectively providing power thereto.

3. A portable convection heater for removing ice from a side walk as set forth in claim 2 and further including a motorized blower housing elevation control assembly with a motor adapted raise the housing upon the receipt of a raise signal and further lower the housing upon the receipt of a lower signal.

4. A portable convection heater for removing ice from a side walk as set forth in claim 3 wherein the blower housing elevation control assembly includes at least one vertically oriented rack coupled between the bottom spaced bars of the cart assembly and at least one motor situated within the heat blower housing with a gear protruding therefrom and engaging the at least one rack.

5. A portable convection heater for removing ice from a side walk as set forth in claim 2 and further including a pair of lights situated on a front face of the housing for illuminating upon the receipt of power.

6. A portable convection heater for removing ice from a side walk as set forth in claim 2 wherein the cart assembly includes a lower extent having a pair of bottom spaced bars with a vertical orientation, a pair of intermediate spaced bars each having a bottom end integrally coupled to a top end of the corresponding bottom spaced bar and extending upwardly and rearwardly therefrom, and a pair of horizontal handles defining grips which are coupled to a top end of an associated one the intermediate spaced bars and extending rearwardly therefrom, wherein the intermediate spaced bars extend outwardly from the bottom ends to the top ends thereof and the axle is coupled to the bottom spaced bars.

7. A portable convection heater for removing ice from a side walk as set forth in claim 2 wherein the blower housing has an internal cavity situated within an interior space with a top face and beveled side faces.

8. A portable heater for removing ice from a side walk comprising:

a cart assembly including an axle and a pair wheels rotatably coupled to the axle for allowing the pushing of the cart assembly;

a heater housing having at least one heater for providing heat, wherein the housing is slidably coupled to the cart assembly thus allowing relative vertical movement thereof to control an amount of heat evenly applied to a recipient surface, wherein the heater is moved along a linear vertical axis; and at least one control switch connected to the heater and a power source for selectively providing power thereto; and a motorized housing elevation control assembly with a motor adapted raise the housing upon the receipt of a raise signal and further lower the housing upon the receipt of a lower signal.

* * * * *